United States Patent [19]

Babiol et al.

[11] 4,335,815

[45] Jun. 22, 1982

[54] FLEXIBLE PACKAGE FOR STORING AND DISPENSING LIQUID OR PASTY MATTERS

[75] Inventors: Pierre Babiol, Villefranche-sur-Saone; Philippe Gallais, Bordeaux, both of France

[73] Assignee: Societe Nouvelle de Bouchons Plastiques, Anse, France

[21] Appl. No.: 190,002

[22] Filed: Sep. 23, 1980

[30] Foreign Application Priority Data

Sep. 26, 1979 [FR] France ..... 79 24561

[51] Int. Cl.[3] ..... B65D 35/08; B65D 85/14

[52] U.S. Cl. ..... 206/277; 206/484; 206/528; 222/107

[58] Field of Search ..... 206/484, 277, 530, 528; 222/107

[56] References Cited

U.S. PATENT DOCUMENTS

| | | | |
|---|---|---|---|
| 2,663,461 | 12/1953 | Brown | 222/107 |
| 2,808,926 | 10/1957 | Drake et al. | 222/107 |
| 3,221,939 | 12/1965 | Brown | 222/107 |
| 3,353,714 | 11/1967 | Trecek | 222/107 |
| 3,635,376 | 1/1972 | Hellstrom | 222/107 |

FOREIGN PATENT DOCUMENTS 414085 2/1966 Australia .

*Primary Examiner*—William T. Dixson, Jr.
*Attorney, Agent, or Firm*—Dowell & Dowell

[57] ABSTRACT

The present invention relates to a flexible package for storing and dispensing liquid or pasty matters, of the type made by moulding a plastics material and comprising a tube extended by an endpiece, the joining portion of these two parts being such as to allow the complete expulsion of the product, wherein the joining portion is deformed irreversibly under the action exerted thereon by the user.

1 Claim, 6 Drawing Figures

FLEXIBLE PACKAGE FOR STORING AND DISPENSING LIQUID OR PASTY MATTERS

The present invention relates to improvements in flexible packages provided with a system for expelling their contents, of the type comprising a tube extended by an end piece or a cannula or nozzle. Such devices are generally used for injecting liquid or pasty products in the human body or in an animal's body.

Devices of the type in question are known, which are manufactured either in one piece, or in two parts, and which contain the exact dose of product necessary for one application.

The first type are generally made of plastisol, i.e. obtained in known manner by moulding around a heated mandrel which is immersed in a bath of this matter.

The second type consist in an extruded tube open at its two ends, one of which is welded at the base of an end piece or nozzle, whilst the other is closed by pinching once the active product has been placed in the tube.

All these devices include a junction between the tube and the nozzle which constitutes a shoulder offering a resistance to crushing which is greater than that of the rest of the tube.

Concerning the devices made of two elements, they require two operations of manufacture, with the result that they are not economical. This mode of manufacture also involves an excess of material at the junction of the two elements, thus further increasing their cost price.

Moreover, another drawback of the two-piece devices is the frequent appearance of a leakage of product at the junction between the tube and the end piece, and all the manufacturing batches must therefore be checked.

The shoulder found in all the devices has a major drawback in that not all the matter contained in the tube can be entirely expelled. The devices presently offered for sale therefore contain about 30% more active product than is necessary, since such a quantity remains at the joining portion between the tube and the nozzle.

Finally, concerning the tubes made of plastisol, they are too flexible, this being detrimental to the correct rigidity of the nozzle.

The improvements forming the subject matter of the present invention aim at remedying these drawbacks and at enabling a device of the type in question to be produced which is of low cost price and avoids too great a loss of active product.

To this end, the package according to the invention is manufactured by injection under pressure of a plastics material, the joining portion between the tube and the nozzle being made in the form, known per se, of a neck constituted by two opposite curvatures which comprise means for completely deforming, irreversibly, under the action exerted thereon by the user to cause complete flattening thereof.

The invention will be more readily understood on reading the following description with reference to the accompanying drawings, in which.

Figure 1:
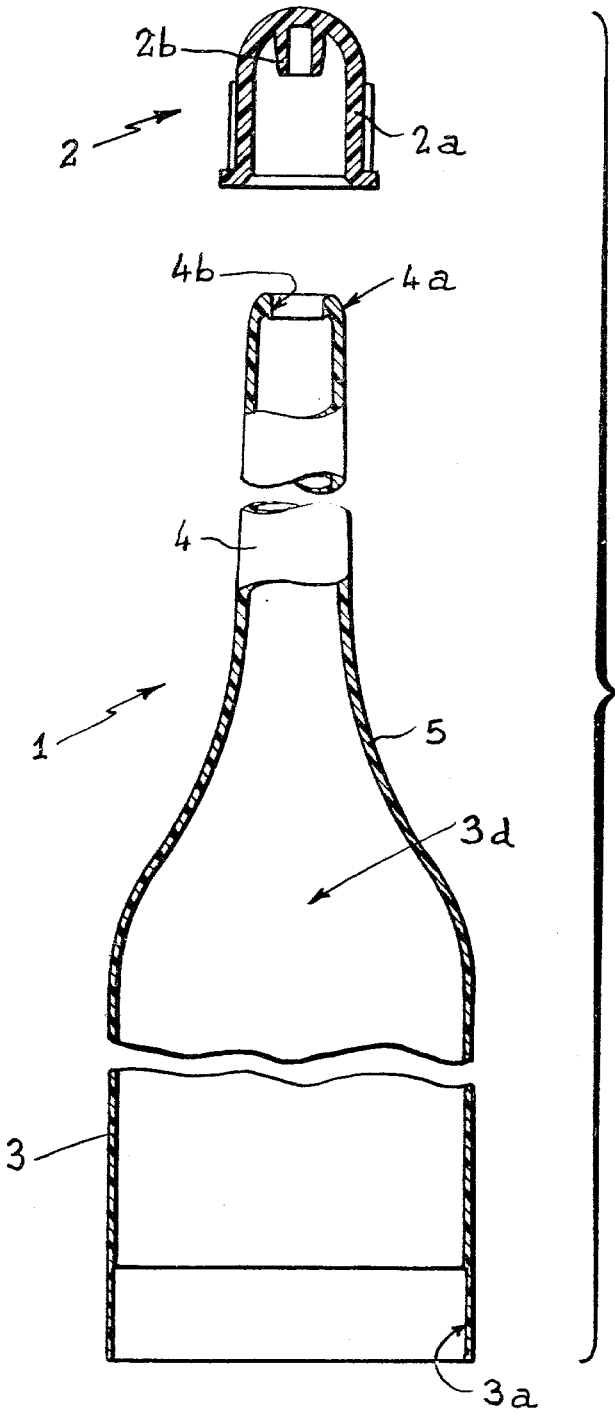
FIG. 1 is an exploded longitudinal view, on a large scale, of a device according to the invention in empty state.

Referring now to the drawings, FIG. 1 shows a device according to the invention which substantially comprises a flexible package 1 and a stopper 2.

Figure 2:
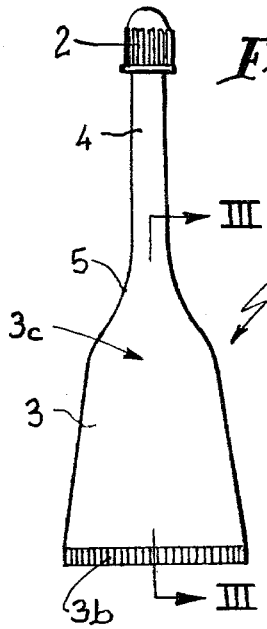
FIG. 2 is an elevational view, in actual size, of a device according to the invention, when full.

The package 1 is made in one piece by moulding a plastic body such as polyethylene or EVA (ethylene-vinyl-acetate), under pressure. It comprises a tubular skirt 3 of constant section, which is extended by a nozzle 4. The skirt portion 3 and the nozzle portion 4 are connected by a joining neck portion 5 formed by two opposite curvatures, of the type met with in bottles. The free end 4*a* of the nozzle is rounded so as not to injure the user when it is inserted in position; it comprises a central expulsion opening 4*b* with calibrated diameter. The thickness of the nozzle is of the order of 0.7 mm, that of the neck decreasing in the direction of the skirt 3 so as to join it at a thickness of the order of 0.4 mm. The radii of the neck are chosen so that said neck constitutes a protection against an excessive penetration into the user of the device; thus, in an advantageous embodiment of the invention, the radii of connection of the neck to the nozzle and to the skirt are respectively tapered from 12 mm to 25 mm. The bottom of the skirt 3 is thinned down over 4 to 5 mm in height to constitute a zone 3*a* facilitating welding once this skirt has been flattened after the device has been filled with the active product (FIG. 2) in upside down position, i.e. with the nozzle oriented downwardly and stoppered.

The stopper 2 is made in the form of a cap 2*a* with a rounded end, whose inner diameter is determined so as to engage freely on the end of the nozzle. The closed end of the stopper comprises an inner lug 2*b* whose diameter is determined so that this lug penetrates by force in the opening 4*b* of the nozzle 4. The lug may comprise peripheral beads (not shown), adapted to increase the holding force of the stopper with respect to the said opening.

Figure 3:
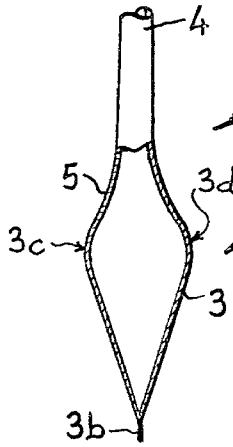
FIG. 3 is a transverse section along III—III (FIG. 2).

Once the device is filled with active product, its transverse section is as shown in FIG. 3, i.e. the bottom of its skirt constitutes a rectilinear edge 3*b* determined by the weld of zone 3*a* after it has been flattened. The presence of the edge 3*b* caused the deformation of the whole skirt 3 which then forms two symmetrical swells 3*c*, 3*d* just before the neck 5. It will be noted that the package 1 advantageously has a volume corresponding to the exact dose of active product which must be used for an application. For example, this package 1 contains the exact dose of a micro-enema or the like, in the form of gel.

Figure 4:
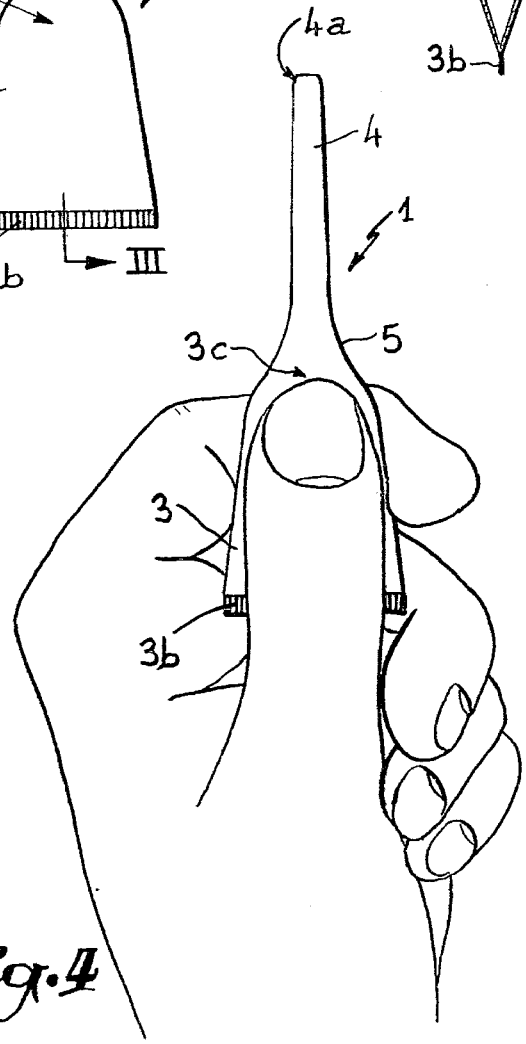
FIG. 4 illustrates the manner of expelling the product contained in the device according to the invention.

To expel the product, it suffices for the user to hold the package between the thumb and fore-finger as illustrated in FIG. 4, these two fingers abutting respectively on the swells mentioned above. By moving the thumb in the direction of the fore-finger, the corresponding swell 3*c* is deformed and easily applied against the inner face of the swell 3*d* (FIG. 5).

Figure 5:
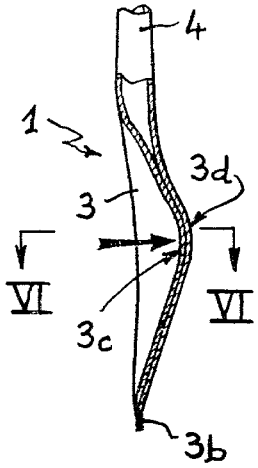
FIG. 5 is a view similar to that of FIG. 3, but corresponding to the position of expulsion of the product.
Figure 6:
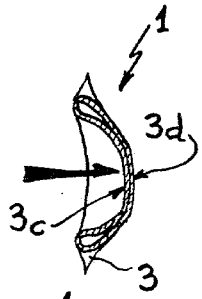
FIG. 6 is a section thereof along VI—VI (FIG. 5).

For the polyethylene serving to make the package, its density or voluminal weight is chosen to ensure a deformation of the swell 3*c* similar to blistering, i.e. at a certain moment, this swell passes through a position of unstable equilibrium and then remains in the concave position shown in FIG. 5 under the effect of the initial force exerted in the direction of arrow F. It will be noted in FIG. 6 that the swell 3*c* is also completely in abutment against the swell 3*d* in the transverse direction.

Thus, when the device according to the invention is used, all the product contained therein is expelled, waste being limited to the volume of product contained in the nozzle.

Finally, it will be noted that the plastics material used for making the device according to the invention comprises a sufficiently high molecular weight to avoid the formation of splits at the welded edge 3*b*.

The preceding description has, of course, been given solely by way of example and it in no way limits the domain of the invention, the replacement of the details of execution described, by any other equivalents, not departing from the scope thereof. In particular, the nozzle 4 may be replaced by an end piece of any shape adapted to the type of flow of the product contained in the package.

What is claimed is:

1. A flexible moulded package for storing and dispensing liquid or pasty materials, the package comprising:

an elongated one-piece hollow body having a material containing skirt portion at one end, the skirt portion having a wall thickness selected to make the skirt portion flexible;

an elongated nozzle portion at the other end of the body, the nozzle portion being much smaller in diameter than the skirt portion and having an opening extending therethrough; the wall thickness of the nozzle portion being made greater than the wall thickness of the skirt to make it more rigid;

an intermediate joining portion interposed between the nozzle portion and the skirt portion and connecting them together along a curved walls of increasing diameter, the wall thickness of the intermediate joining portion tapering from the thickness of the nozzle wall portion to the thickness of the skirt wall portion; and the skirt portion at its end opposite the joining portion being flattened and sealed along a rectilinear edge causing deformation of the skirt portion to form two opposed symetrical swells, such that when one swell is pressed toward the other it passes through a position of unstable equilibrium and lies concavely within the opposite swell in stable equilibrium.

* * * * *